US005378045A

United States Patent [19]

Siekman et al.

[11] Patent Number: 5,378,045

[45] Date of Patent: Jan. 3, 1995

[54] SEAT CUSHION FOR WHEELCHAIRS

[75] Inventors: Allen R. Siekman, Avon Lake; Julius E. Nachod, III, Elyria, both of Ohio

[73] Assignee: Invacare Corporation, Elyria, Ohio

[21] Appl. No.: 108,827

[22] Filed: Aug. 18, 1993

Related U.S. Application Data

[63] Continuation of Ser. No. 791,872, Nov. 13, 1991, abandoned.

[51] Int. Cl.[6] ..... A47C 7/02

[52] U.S. Cl. ..... 297/452.25; 297/452.41; 297/DIG. 6; 297/DIG. 1; 297/452.21; 297/440.1

[58] Field of Search ..... 297/452.1, 452.21, 452.23, 297/452.24, 452.34, 452.36, 452.41, 452.55, DIG. 1, DIG. 2, DIG. 4, DIG. 6, 467, 352, 284.4, 284.6, 284.9; 5/653, 654

[56] References Cited

U.S. PATENT DOCUMENTS

| | | | |
|---|---|---|---|
| 2,966,938 | 1/1961 | Ooton | 297/352 |
| 3,503,649 | 3/1970 | Johnson | 297/459 |
| 4,086,675 | 5/1978 | Talbert et al. | 297/DIG. 1 X |
| 4,099,278 | 7/1978 | Parisi | 297/DIG. 1 X |
| 4,193,150 | 3/1980 | Vineberg | 297/DIG. 1 X |
| 4,234,228 | 11/1980 | Flamm | 297/DIG. 4 X |
| 4,588,229 | 5/1986 | Jay | 297/459 |
| 4,629,246 | 12/1986 | Fulton | 297/440 X |
| 4,643,481 | 2/1987 | Saloff et al. | 297/458 |
| 4,646,374 | 3/1987 | Shafer | 297/DIG. 4 X |
| 4,951,336 | 8/1990 | Silverman | 297/459 X |
| 4,981,131 | 1/1991 | Hazard | 297/DIG. 3 X |
| 5,018,790 | 5/1991 | Jay | 297/458 |
| 5,137,333 | 8/1992 | Chee | 297/458 |

*Primary Examiner*—Kenneth J. Dorner
*Assistant Examiner*—Milton Nelson, Jr.
*Attorney, Agent, or Firm*—Fay, Sharpe, Beall, Fagan, Minnich & McKee

[57] ABSTRACT

A seat cushion for use in a wheelchair comprises a shaped tray and a filled envelope. The envelope is filled with a fluid like material which is flowably displaceable under the weight of a user. The shaped tray comprises a recess for receiving the buttocks region of the user as well as a front edge over which the legs of the user extend. A back wedge is mounted along a back edge of the tray and keeps the filled envelope from sliding over the back edge of the tray. Further, side wings located at the sides of the shaped tray near its front edge help constrain the legs of the wheelchair user in a generally forward direction within the width of the wheelchair seat. Side wedges mounted on the underside of the seat are selectively removable to accommodate the presence of a cross brace mechanism, as is commonly used in drop seat wheelchairs.

8 Claims, 5 Drawing Sheets

SEAT CUSHION FOR WHEELCHAIRS

This is a continuation of application Ser. No. 07/791,872 filed on Nov. 13, 1991 (now abandoned).

BACKGROUND OF THE INVENTION

I. Field of the Invention

This invention relates to a seat cushion to be used with a wheelchair, and more specifically to a seat cushion incorporating a shaped tray and an envelope filled with a flowable gel-like material.

II. Description of the Related Art

Users of wheelchairs typically have little or no use of their lower extremities. As such, they sit in wheelchairs, or similar structures such as recliners or beds, for long periods of time. Persons sitting in conventional wheelchairs or seats for long periods of time are sometimes prone to develop pressure sores, such as bed sores, at different points in the person's body which bear the weight of his body. For example, a person sitting upright in a wheelchair distributes his body weight over a relatively small area. As such, users of wheelchairs are prone to develop pressure sores.

In addressing this problem, related inventions have utilized envelopes filled with various cushioning media including air, elastomeric foams, and gels. In some embodiments, the gel has been mixed with lightening substance, such as hollow glass spheres, which tend to lighten the weight of the gel-filled envelope.

Some prior art designs have provided segments within the envelopes to improve the lateral stability to the user. For example, U.S. Pat. No. 4,588,229 to Jay discloses an envelope featuring a seam 39 separating the envelope into right and left hand portions. This seam prevents gel within the envelope from shifting from right to left within the envelope under the weight of the user, thereby enhancing the stability of the cushion. Also disclosed in U.S. Pat. No. 4,588,229 is a shaped tray designed to be used with the above-discussed envelope. The shaped tray is made of a lightweight material and has a depressed seat area 42 surrounded by rims 44, 46 on each side and a rim 48 in the front. The envelope is designed to be attached to the top surface of the tray and for them to be used as a unit.

The present invention contemplates a new and improved shaped tray which overcomes the foregoing difficulties and others while providing and more advantageous overall results.

SUMMARY OF THE INVENTION

In accordance with the present invention, a new and improved shaped tray to be used with a filled envelope is provided.

According to one aspect of the invention, a seat cushion comprises a shaped tray and a filled envelope. The shaped tray has front, back and side edges and top and bottom surfaces. A back wedge is aligned near the back edge of the tray. The filled envelope is filled with a fluid-like material which is flowably displaceable under the weight of the user. The back wedge of the shaped tray is effective to prevent the envelope from sliding over the back edge of the shaped tray.

According to another aspect of the invention, the back wedge is made of polyurethane foam and comprises a bearing surface, a bottom surface and a back surface. The bearing surface is inclined to the bottom surface of the shaped tray at an angle greater than 5°.

The bottom surface of the back wedge has a slot to selectively receive attaching means for attaching the back wedge to the tray. The back wedge has a cross section generally resembling a right triangle.

According to another aspect of the invention, a seat adapted to be used in an associated wheelchair and sat upon by a user comprises a shaped tray and a side wedge. The side wedge is selectively affixed to a bottom surface of the tray in either one of the side edges. The side wedge is selectively removable to accommodate a cross brace of an associated drop seat wheelchair.

According to another aspect of the invention, a seat adapted to be used in an associated-wheelchair comprises a shaped tray and a first side wing. The first side wing rises upwardly from a top surface of the tray and is located on one of the side edges near the front edge of the tray. The side wing constrains the user's legs in a forward direction.

In another aspect of the invention, an abductor is selectively affixed to the top surface of the shaped tray and cooperates with first and second side wings to form first and second channels. The channels selectively receive and orient the legs of the wheelchair user.

One advantage of the present invention is the capability of retaining the fluid-filled envelope on the top surface of the shaped tray and preventing the fluid filled envelope from sliding over the back edge of the shaped tray.

Another advantage of the present invention is the feature of side wedges. By selectively removing or adjusting the side wedges, the seat can be fitted around cross braces typically found in a drop seat wheelchair. Previously, a user had to cut slots out of the bottom surface of a shaped tray in order to accommodate such cross braces.

Another advantage of the present invention is the capability of orienting the user's legs in a generally forward direction. Previously, it was not uncommon for the user's legs, which are typically uncontrollable due to injury or illness, to stray from a forward direction. Instead, the legs were prone to splay outwardly or to twist around one another. The use of side wings and the abductor creates first and second channels which can selectively receive legs of the wheelchair user and orient them in a forward direction.

Another advantage of the invention is the increased stability to the user, especially side-to-side, due to the longitudinal separation of the envelope into halves.

Still another advantage of the invention is the comfort and improved support offered to the user through the use of the filled envelope.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings, wherein.

DESCRIPTION OF THE PREFERRED EMBODIMENT

Figure 1:
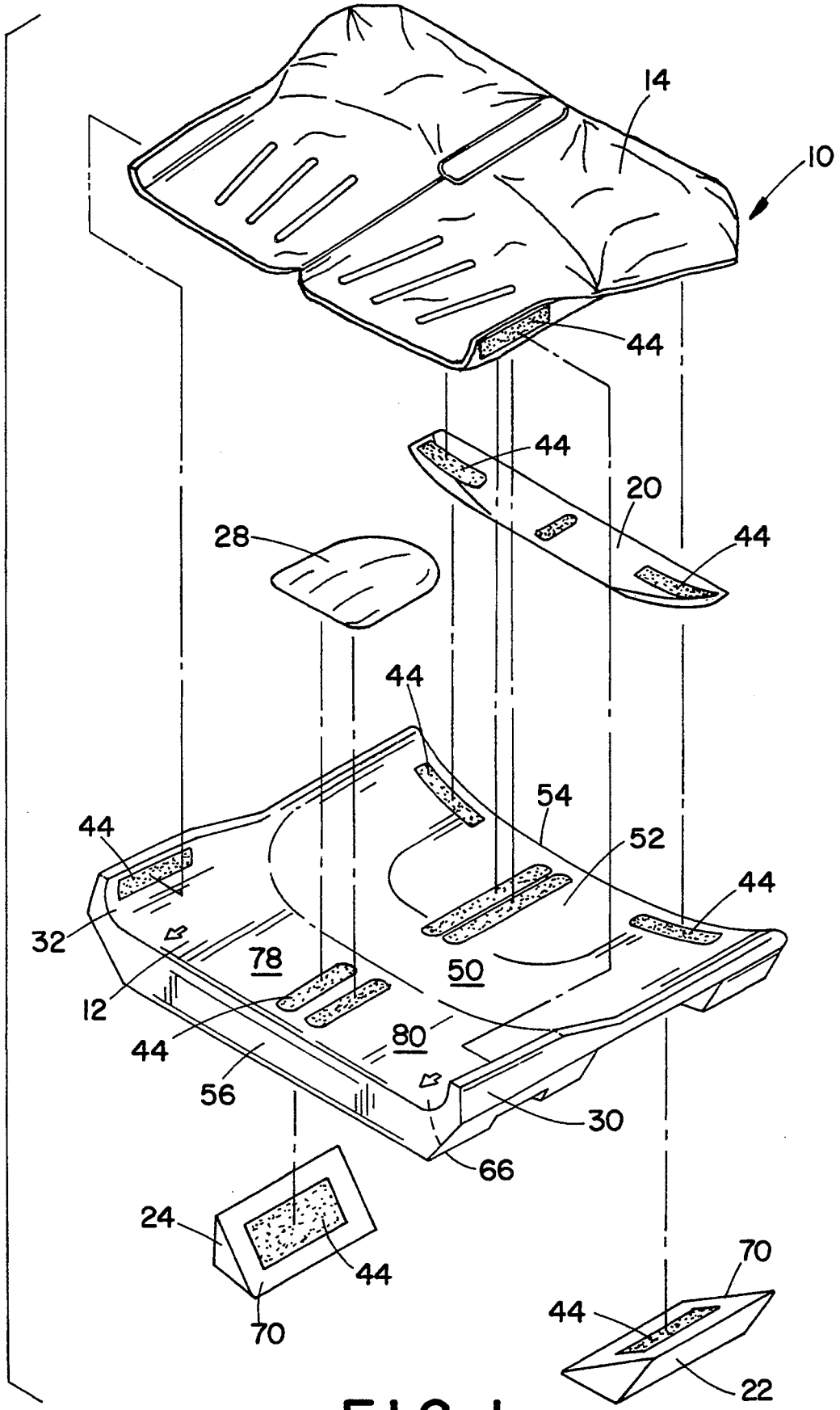
FIG. 1 is a prospective exploded view of a seat cushion according to the invention.

Referring now to the drawings wherein the showings are for purposes of illustrating a preferred embodiment of the invention only and not for purposes of limiting the invention, FIG. 1 shows an exploded view of a seat cushion 10 according to the invention. The seat cushion is primarily comprised of shaped tray 12 and envelope 14.

Figure 7:
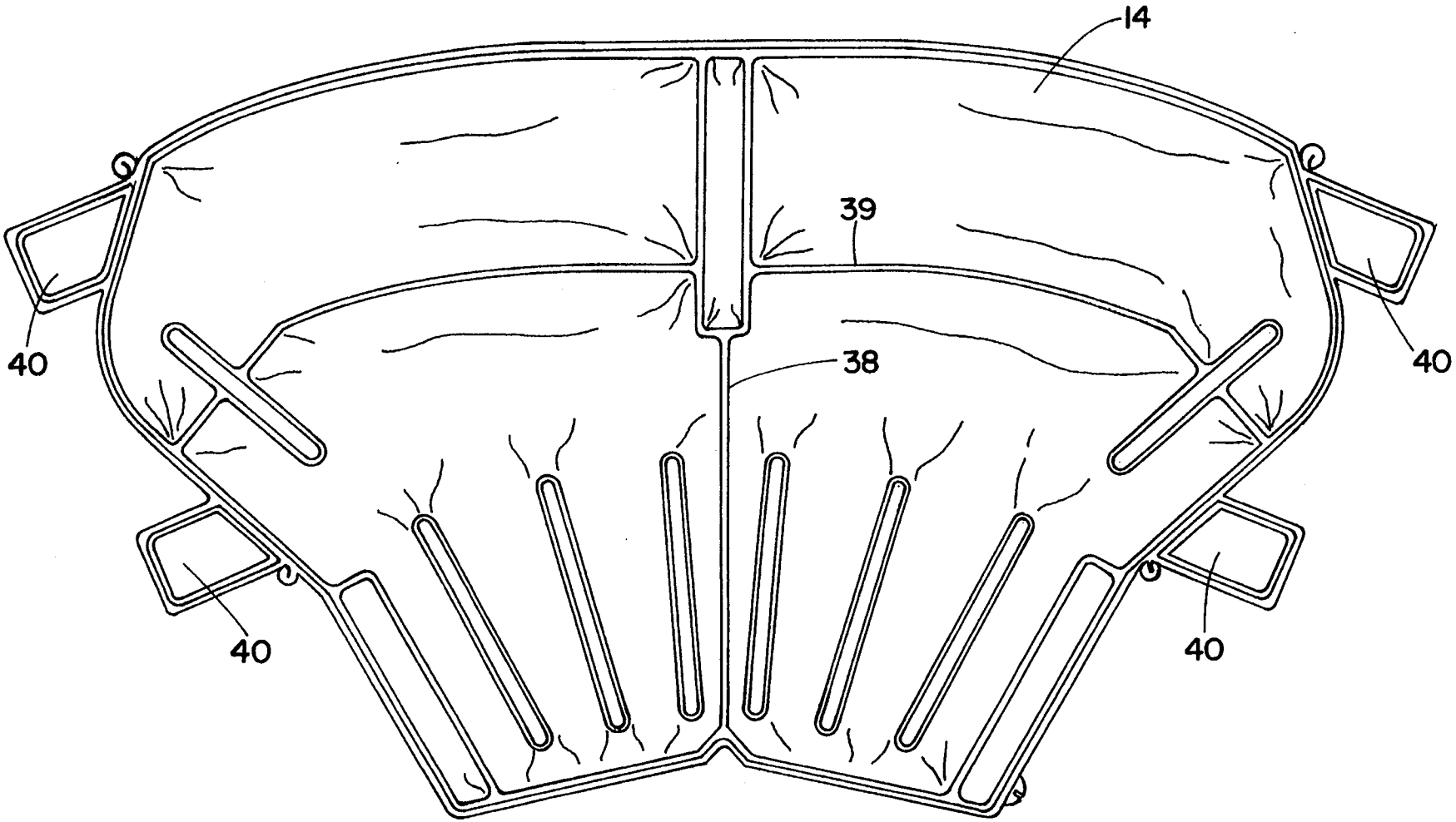
FIG. 7 is a plan view of an envelope as is used with the invention.

The envelope 14 is filled with a flowable fluid-like material which is flowably displaceable under the weight of the wheelchair user. With reference to FIG. 7, the preferred embodiment of the envelope is disclosed, although its specific structure is not a part of the invention, and any filled envelope used for such shaped tray wheelchair applications is suitably used with the invention. The envelope 14 is split into right and left portions via heat seams 38 and inner and outer portions via heat seams 39. Preferably, heat seams are made throughout the envelope 14 to prevent of the fluid-like material from flowing too far within the envelope 14 under the weight of the user. For example, if all of the fluid in the envelope 14 should flow to one side of the envelope 14, the user would be essentially sitting on an inclined plane and would tend to pitch to one side of the wheelchair. Since the user of the wheelchair typically has little or no control of the lower portions of their body, such lateral instability is of concern. The partitioning of the envelope 14 by the seams 38 and 39 tends to create a more stable envelope 14, thereby increasing not only the comfort, but also the stability, of the user.

The preferred fill material is hollow glass spheres. In the preferred embodiment, these spheres are SCOTCHLITE ® glass bubbles, available from 3M ® Corporation. The type utilized in the preferred embodiment is 3M ® designation C15/250, having a nominal density of 0.15 grams/cc. and 9.4 lbs./cu.ft. Its range is 0.12–0.18 grams/cc., with a bulk density of 0.07–0.12 grams/cc. Their size is a maximum of 5% by weight +US 80 mesh (177 microns).

The preferred fluid-like material is petrolatum. This petrolatum is mixture of a hydrocarbon oil and wax can be purchased from Pennzoil Products Co. under the tradename PENRECO ® Amber. The petrolatum or petroleum jelly is a microcrystalline wax with a defined oil content. Microcrystalline waxes consist mainly of iso and cycloparaffins with some alkylated aromatic hydrocarbons. Petrolatums have consistencies at 77° F. USP and ASTM D937 between 35 and 410 with a melting point between 95° F. and 170° F. Petrolatums are non-toxic and some petrolatums have been approved for food and medicinal use. It has a semi-solid appearance and is odorless. It melts at between 122° F. and 135° F. with a specific gravity of 0.86 at 60° F. The density of the petrolatum ranges from 0.83 gm/cc–0.87 gm/cc.

In the preferred embodiment, the fill material is produced by mixing four 50 pound boxes of 3M ® Scotchlite glass bubbles with three 55 gallon drums of the Penreco ® Amber petrolatum. The resulting fill material is comprised of approximately 49.2% glass bubbles by volume and 50.8% petrolatum by volume. In such a case, the volume of petrolatum comprising the fill material is not substantially greater than the volume of the interstitial spaces of the quantity of glass beads alone which ranges from 0% to 61% by volume depending upon the bulk density and average true density of the 3M ® type C15/250 glass bubbles present in a specific batch.

Figure 8:
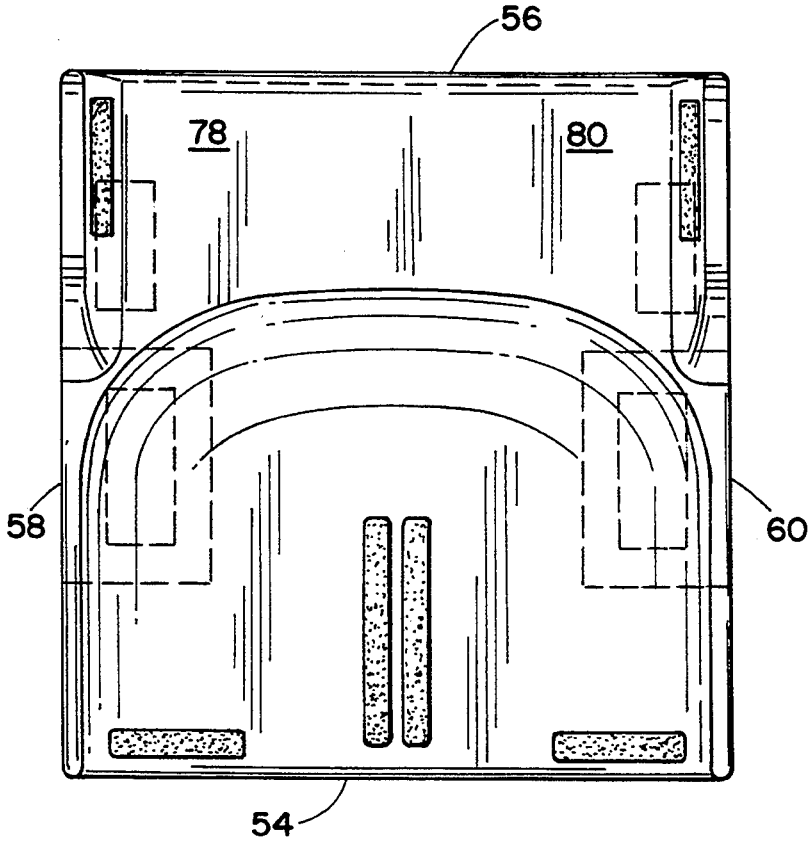
FIG. 8 is a plan view of a shaped tray according to the invention.

In the preferred embodiment, the envelope is filled via fill spouts 40. The fill spouts are then sealed via a heat sealing mechanism. With reference to FIGS. 1 and 8, hook and loop strips 44 are positioned on the tray 12 and on the bottom portion of the envelope 14. Corresponding hook and loop strips on the tray 12 and envelope 14 secure the tray to the envelope in a selectively removable manner.

With reference to FIGS. 1 and 8–10, the shaped tray 12 features several innovative features. Shaped trays in general, have been known in the art. They typically contain an upper surface 50 having a recess 52. The recess 52 is designed to selectively receive the buttocks region of the user. As such, the shaped tray 12 comprises a back edge 54, a front edge 56 and side edges 58, 60 (FIG. 8). The legs of the user extend fully over the front edge 56 while the buttocks are received within recess 52.

A common problem in prior art designs has been the tendency of the filled envelope 14 to slide backwards over the back edge 54 of the tray 12 due to movement or slumping by the user.

Figure 4:
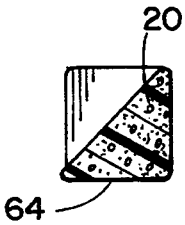
FIG. 4 is a side view of a back wedge according to the invention.
Figure 5:
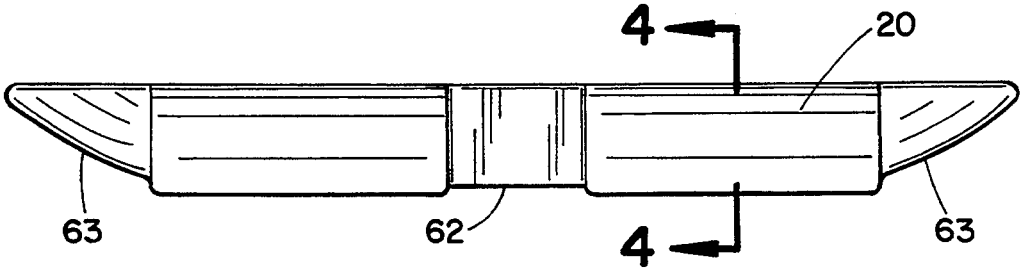
FIG. 5 is a plan view of a back wedge according to the invention.
Figure 6:
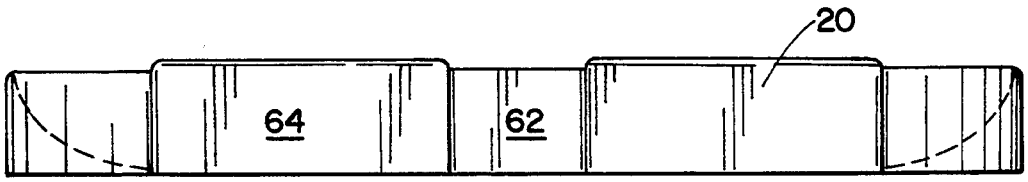
FIG. 6 is a plan view of a back wedge according to the invention.

With references to FIGS. 1, and 4–6, applicant has developed a back wedge 20. The back wedge 20 is shaped to fit the lines of recess 52. The back wedge 20 contains hook and loop strips 44 which attach the back wedge 54 to the shaped tray 12. The back wedge 20 is selectively removable in order to accommodate a user with an abnormally tilted pelvis. In such cases, a permanently affixed back wedge 20 would be unsuitable. As is most clearly seen by FIG. 4, the back wedge has a triangular cross section, with two angles preferably near 45°, which retains the fluid-filled envelope 14 onto the surface of the tray 12 in a most advantageous manner. The angle of the wedge 20 must be sufficient to prevent the fluid-filled envelope 14 from sliding off the back of the tray 12. It is believed that even a small angle, such as 5°, could be sufficient although the 45° angle shown in FIG. 4 is preferred. In the preferred embodiment, the wedge 20 is approximately 1.3 inches by 1.3 inches on the non-hypotenuse sides of the triangle shown in FIG. 4. In one embodiment, the back wedge 20 was made of polyurethane foam. A slot 62 in the bottom surface 64 of the back wedge 20 receives hook and loop strips 44 mounted on the center of recess 52. Similarly, recesses 63 on the ends of the back wedge 20 also receives hook and loop strips 44.

Figure 2:
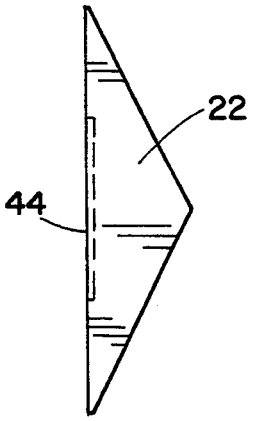
FIG. 2 is a side view of a side wedge according to the invention.
Figure 3:
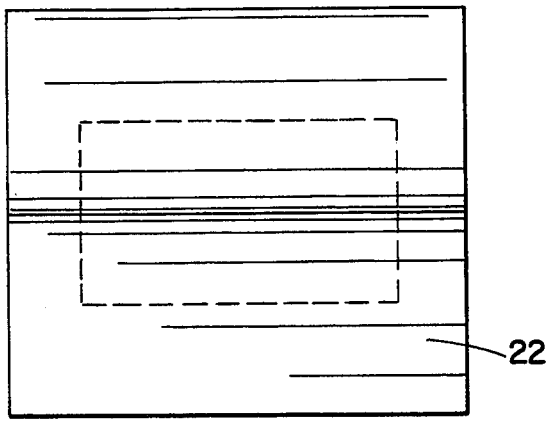
FIG. 3 is a plan view of a side wedge according to the invention.
Figure 11:
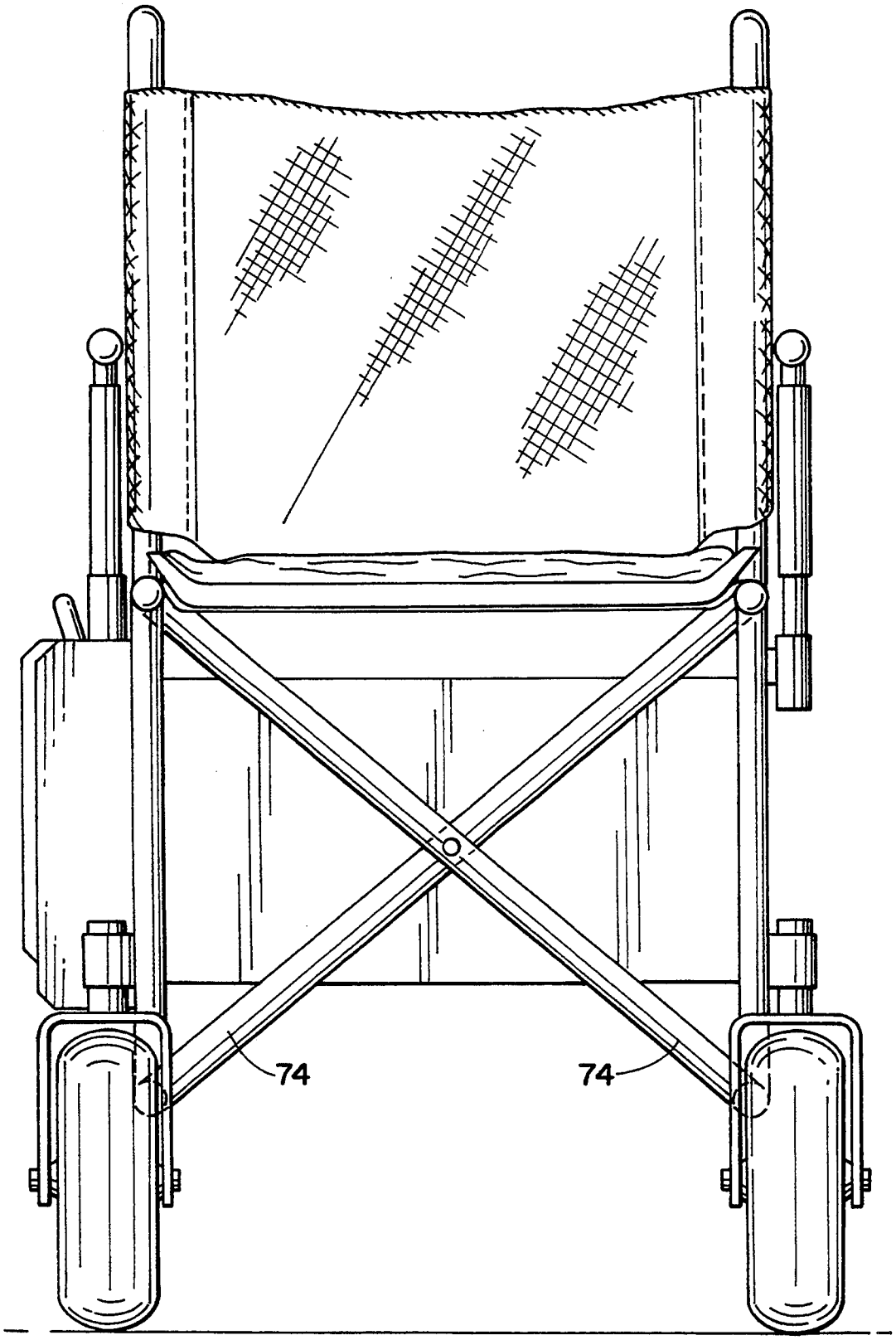
FIG. 11 is a front view of a typical drop seat wheelchair utilizing cross braces as might be typically used with the invention.

With reference to FIGS. 1–3, side wedges 22, 24, are selectively mounted to a bottom surface 66 of tray 12 near the side edges 58, 60. The upper surface 70 of the side wedges 22, 24 feature hook and loop strips 44 which cooperate with corresponding hook and loop strips 44 on the bottom surface 66 of the tray 12. In another embodiment, the side wedges 22, 24 are mounted to the bottom surface 66 of tray 12 via an interference fit. The side wedges 22, 24 are selectively removable to accommodate cross braces such as are typically found in drop seat wheelchairs. For example, with reference to FIG. 11, such a typical drop seat wheelchair is disclosed. The cross braces 74 add support to the drop seat wheelchair while allowing it to be folded for easy storage. The upper surface of the cross braces 74 can present problems to shaped trays of prior art designs. Typically, a user of a drop seat wheelchair featuring a cross brace would cut away portions of the underside of typical foam shaped trays with knives or razor blades, thereby providing a recess to receive the cross braces 74. In applicant's structure, the side wedges 22, 24 can be easily removed if the tray 12 is to be used in such a drop seat wheelchair. If the tray 12 is to then be removed from the wheelchair and placed in a different style of wheelchair, having no cross braces, the side wedges 22, 24 are easily and repeatably replaced.

Figure 10:
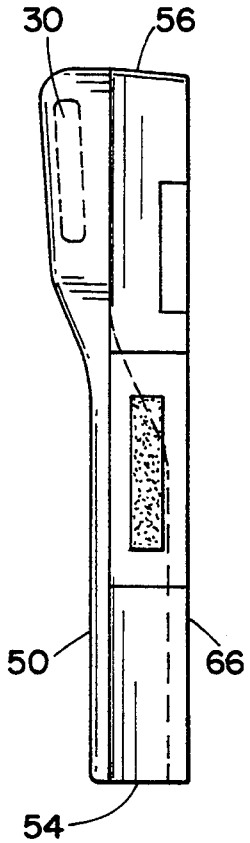
FIG. 10 is a side view of a shaped tray according to the invention.
Figure 9:
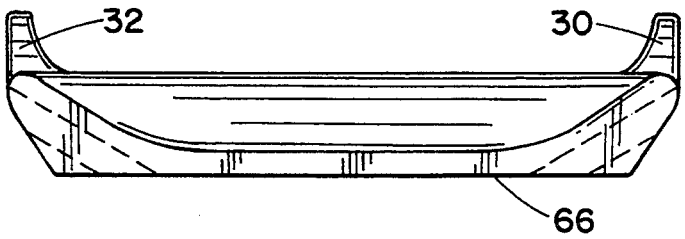
FIG. 9 is a back view of a shaped tray according to the invention.

With reference to FIGS. 1 and 8–10, the upper surface 50 of the shaped tray 12 also features side wings 30, 32. The side wings 30, 32 are located near the front edge 56 of the upper surface 50 of the shaped tray 12. The side wings 30, 32, as is best seen in FIGS. 9 and 10, rise upwardly from the upper surface 50 of the shaped tray 12. Typically, the user of the wheelchair has little or control of or feeling in their lower extremities. As such, it is difficult for them to keep their legs oriented forwardly in the chair and within the outer edges of the chair and/or seat 10. Sometimes involuntary muscular contractions cause the legs of the user to splay outwardly or twist inwardly about each other. The side wings 30, 32 help constrain the legs of the user in a forward direction.

Consistent with this objective is the use of abductor 28. The abductor is mounted between the side wings 30, 32 on the upper surface 50 of shaped tray 12. The abductor, along with the side wings 30, 32, create first and second channels 78, 80 to receive the legs of the user.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A seat cushion apparatus for use in an associated wheelchair, said seat cushion comprising:

a shaped tray, said tray having front, back, and first and second side edges and top and bottom surfaces, said tray shaped to receive the buttocks of the user when the user is in a sitting position, the legs of said user extending forward toward said front edge of said tray;

attaching means;

an envelope, said envelope filled with a flowable material which is displaced within the envelope under the weight of the user, said envelope attached to said top surface of said tray via said attaching means;

a back wedge, said back wedge having a bearing surface, a bottom surface, and a back surface, said back wedge attached to said tray near said back edge via said attaching means, said bearing surface of said back wedge lying adjacent to an edge of said envelope and effective to prevent said envelope from sliding over said back edge of said tray due to movement by said user;

first and second side wedges, said first side wedge selectively affixed to said bottom surface of said tray near said first side edge via said attaching means, said second side wedge selectively affixed to said bottom surface of said tray near said second side edge via said attaching means, said first and second side wedges selectively removable from said bottom surface of said tray to accommodate cross braces of an associated drop seat wheelchair;

first and second side wings, said first side wing rising upwardly from said top surface of said tray on said first side edge of said tray near said front edge, said second side wing rising upwardly from said top surface of said shaped tray at said second side edge near said front edge, said first and second side wings effective to retain the legs of said user in a generally forward manner and preventing them from splaying outwardly; and, an abductor, said abductor selectively attached to said top surface of said shaped tray near said front edge and positioned approximately equal distantly between said first and second side wings, said abductor cooperating with said first and second side wings to create a first and second channel, said first and second channels effective to receive the legs of the user and to discourage them from splaying outwardly or twisting about each other while the user is sitting within the wheelchair.

2. The seat cushion apparatus of claim 1 wherein said back wedge is made of polyurethane foam.

3. The seat cushion apparatus of claim 1 wherein said attaching means are hook and loop strips.

4. A drop seat wheelchair, said wheelchair comprising:

a frame, said frame having cross braces;

wheels rotatably attached to said frame;

a shaped tray, said tray having front, back, and first and second side edges and top and bottom surfaces, said tray shaped to receive the buttocks of the user when the user is in a sitting position, the legs of said user extending forward toward said front edge of said tray;

attaching means;

an envelope, said envelope filled with a flowable material which is displaced within the envelope under the weight of a user, said envelope attached to said top surface of said tray via said attaching means;

a back wedge, said back wedge having a bearing surface, a bottom surface, and a back surface, said back wedge attached to said tray near said back edge via said attaching means, said bearing surface of said back wedge lying adjacent to an edge of said envelope and effective to prevent said envelope from sliding over said back edge of said tray due to movement by said user;

first and second side wedges, said first side wedge selectively affixed to said bottom surface of said tray near said first side edge via said attaching means, said second side wedge selectively affixed to said bottom surface of said tray near said second side edge via attaching means, said first and second side wedges selectively removable from said bottom surface of said tray to accommodate cross braces of an associated drop seat wheelchair;

first and second side wings, said first side wing rising upwardly from said top surface of said tray on said first side edge of said tray near said front edge, said second side wing rising upwardly from said top surface of said shaped tray at said second side edge near said front edge, said first and second side wings effective to retain the legs of said user in a generally forward manner and preventing them from splaying outwardly; and, an abductor, said abductor selectively attached to said top surface of said shaped tray near said front edge and positioned approximately equal distantly between said first and second side wings, said abductor cooperating with said first and second side wings to create a first and second channel, said first and second channels effective to receive the legs of the user and to discourage them from splaying outwardly or twisting about each other while the user is sitting within the wheelchair.

5. The drop seat wheelchair of claim 4 wherein said back wedge is made of polyurethane foam.

6. The drop seat wheelchair of claim 4 wherein said attaching means are hook and loop strips.

7. A seat cushion apparatus for use in an associated wheelchair, said seat cushion comprising:

a shaped tray, said tray having a front edge, a back edge, and first and second side edges and top and bottom surfaces;

hook and loop strips;

an envelope filled with a flowable material which is displaced within the envelope under the weight of a user, said envelope attached to said top surface of said tray via said hook and loop strips;

a back wedge, said back wedge having a bearing surface, a bottom surface, and a back surface, said back wedge attached to said tray near said back edge via said hook and loop strips, said bearing surface of said back wedge lying adjacent to an edge of said envelope and effective to prevent said envelope from sliding over said back edge of said tray due to movement by said user.

8. A seat cushion apparatus for use in an associated wheelchair, said seat cushion comprising:

a shaped tray, said tray having a front edge, a back edge, and first and second side edges and top and bottom surfaces;

attaching means;

an envelope filled with a flowable material which is displaced within the envelope under the weight of a user, said envelope attached to said top surface of said tray via said attaching means;

a back wedge comprised of polyurethane foam, said back wedge having a bearing surface, a bottom surface, and a back surface, said back wedge attached to said tray near said back edge via said attaching means, said bearing surface of said back wedge lying adjacent to an edge of said envelope and effective to prevent said envelope from sliding over said back edge of said tray due to movement by said user.

* * * * *